US006175958B1

(12) United States Patent
Wu

(10) Patent No.: US 6,175,958 B1
(45) Date of Patent: Jan. 23, 2001

(54) BULLETPROOF VEST

(76) Inventor: Bo Kun Wu, No. 391, Hsintu Road, Tainan City, Tainan (TW)

( * ) Notice: Under 35 U.S.C. 154(b), the term of this patent shall be extended for 0 days.

(21) Appl. No.: 09/434,573

(22) Filed: Nov. 4, 1999

(30) Foreign Application Priority Data

Jun. 25, 1999 (TW) ..... 88210524

(51) Int. Cl.[7] ..... F41H 1/02; F41H 5/08
(52) U.S. Cl. ..... 2/2.5; 2/92; 2/102; 89/36.05
(58) Field of Search ..... 2/2.5, 92–95, 97, 2/102, 108, 117, 230, 243.1, 248, 326, 455, 462–463, 467; 89/36.01, 36.05

(56) References Cited

U.S. PATENT DOCUMENTS 2,747,190 * 5/1956 Foster ..... 2/2.5
3,557,384 * 1/1971 Barron et al. ..... 2/2.5
4,413,357 * 11/1983 Sacks ..... 2/2.5
4,485,491 * 12/1984 Rasmussen ..... 2/2.5
4,507,802 * 4/1985 Small ..... 2/2.5
4,696,066 * 9/1987 Ball et al. ..... 2/272
4,774,724 * 10/1988 Sacks ..... 2/2.5
5,073,985 * 12/1991 Stone et al. ..... 2/2.5
5,325,538 * 7/1994 Schoenweiss et al. ..... 2/2.5
5,327,811 * 7/1994 Preice et al. ..... 89/36.05
5,495,620 * 3/1996 Schoenweiss et al. ..... 2/2.5
5,991,925 * 11/1999 Wu ..... 2/102

* cited by examiner

*Primary Examiner*—J. Calvert
*Assistant Examiner*—Tejash Patel
(74) *Attorney, Agent, or Firm*—Pro-Techtor International Services

(57) ABSTRACT

A bulletproof vest which includes a vest body, the vest body having two receiving spaces respectively defined in two front panels thereof, two front openings respectively disposed at a front placket thereof in communication with the receiving spaces, and a rear opening disposed at a back panel thereof at an inner side between the receiving spaces, a front bulletproof shield mounted in the receiving spaces inside the vest body to protect the user's front side against bullet, the front bulletproof shield having two opposite extended lateral side portions respectively extended out of the rear opening at the vest body and fastened together by a hook joint, and a rear bulletproof shield fastened to the vest body at a back side by hook and loop materials to protect the user's back side against bullet.

10 Claims, 13 Drawing Sheets

BULLETPROOF VEST

BACKGROUND OF THE INVENTION

The present invention relates to a bulletproof vest, and more particularly to such a bulletproof vest, which has a front bulletproof shield mounted in a fabric vest body thereof and kept from sight.

Regular bulletproof vests for policemen are directly worn on the user on the outside or inside a short coat. These bulletproof vests are commonly heavy, not comfortable in use. When wearing a bulletproof vest either on the outside or under a short coat, evil fellows can easily discover the bulletproof at a glance.

SUMMARY OF THE INVENTION

It is one object of the present invention to provide a bulletproof vest, which is shaped like an ordinary vest so that evil fellows cannot easily discover the bulletproof nature of the vest. It is another object of the present invention to provide a bulletproof vest, which is comfortable in use. According to one aspect of the present invention, the bulletproof vest comprises a vest body, the vest body having two receiving spaces respectively defined in two front panels thereof, two front openings respectively disposed at a front placket thereof in communication with the receiving spaces, and a rear opening disposed at a back panel thereof at an inner side between the receiving spaces, a front bulletproof shield mounted in the receiving spaces inside the vest body to protect the user's front side against bullet, the front bulletproof shield having two opposite extended lateral side portions respectively extended out of the rear opening at the vest body and fastened together by a hook joint, and a rear bulletproof shield fastened to the vest body at a back side by hook and loop materials to protect the user's back side against bullet. According to another aspect of the present invention, two suspenders are respectively provided at two opposite lateral sides of the rear bulletproof shield for fastening to the user's pants or respective retaining elements at the front sidewall of the front bulletproof shield. According to still another aspect of the present invention, the rear bulletproof shield comprises two loops bilaterally provided on the middle, and two shoulder straps bilaterally provided near a top side thereof and respectively fastened to the loops to secure the rear bulletproof shield to the user's shoulders. According to still another aspect of the present invention, hook and loop materials are respectively provided at the vest body and the rear bulletproof shield, for enabling the rear bulletproof shield to be detachably fastened to the vest body.

DETAILED DESCRIPTION OF THE PREFERRED EMBODIMENT

Figure 1:
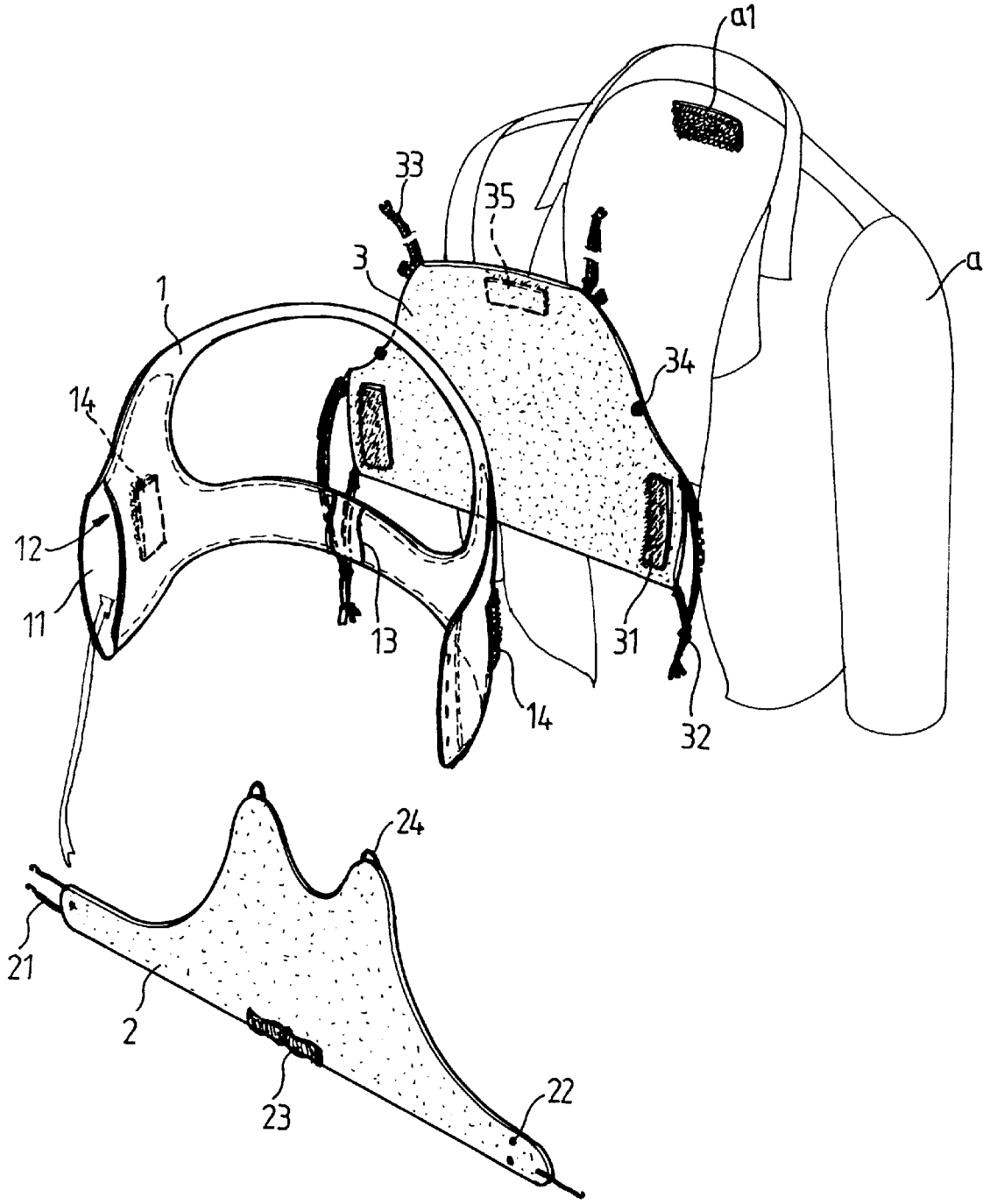
FIG. 1 is an exploded view of a bulletproof vest and a jacket according to the present invention.
Figure 2:
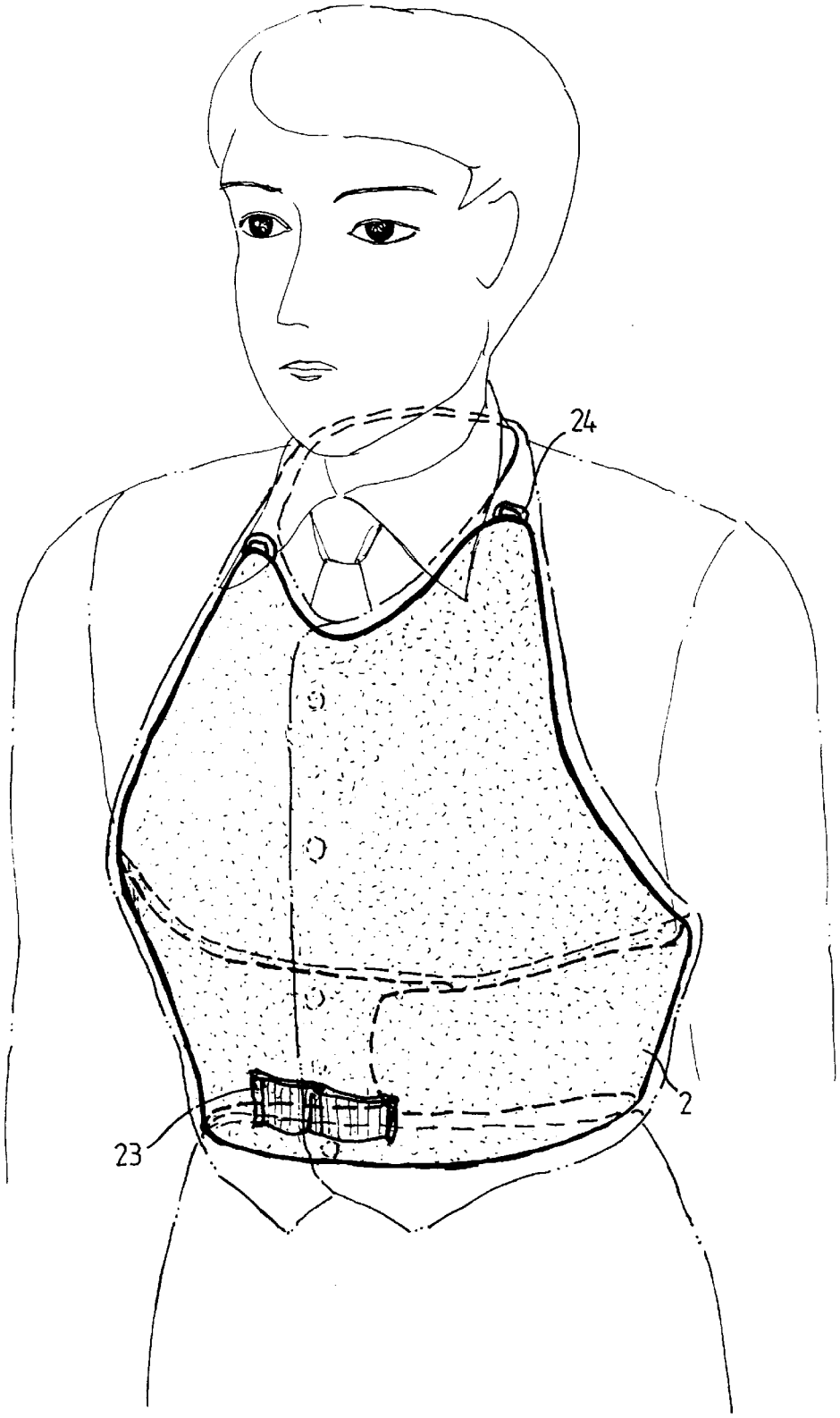
FIG. 2 is a front view of the present invention, showing the bulletproof vest worn on the user's body.
Figure 3:
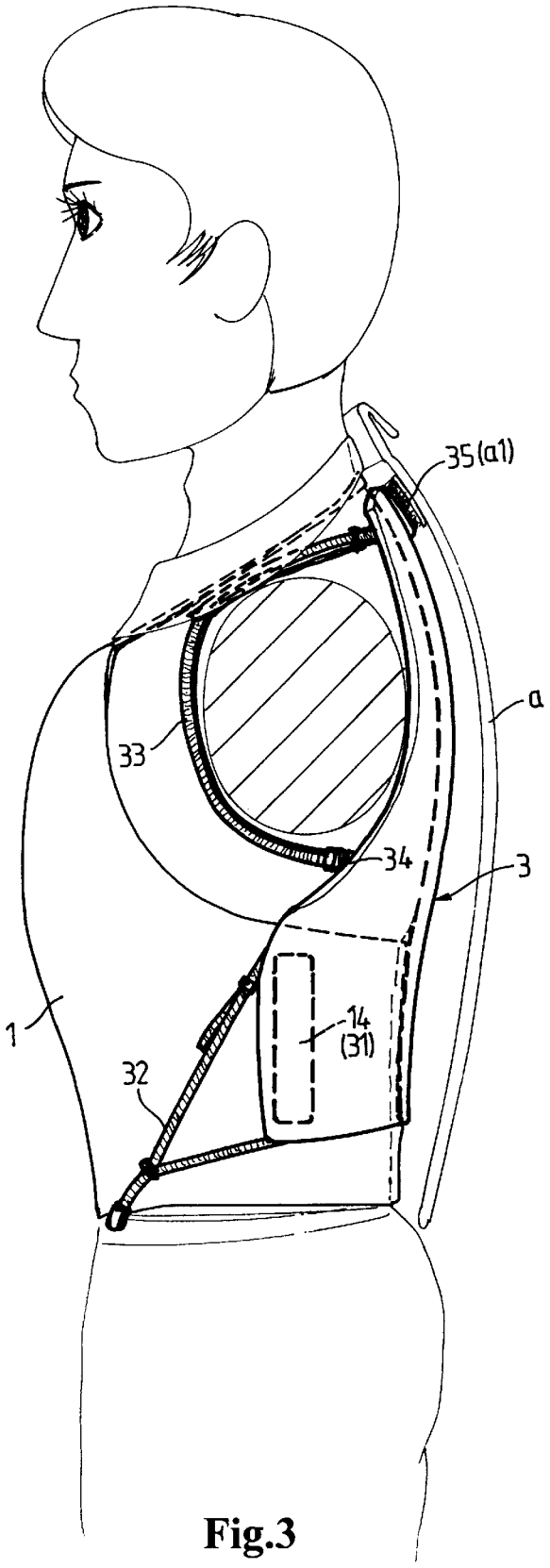
FIG. 3 is a left side view in section of FIG. 2.
Figure 4:
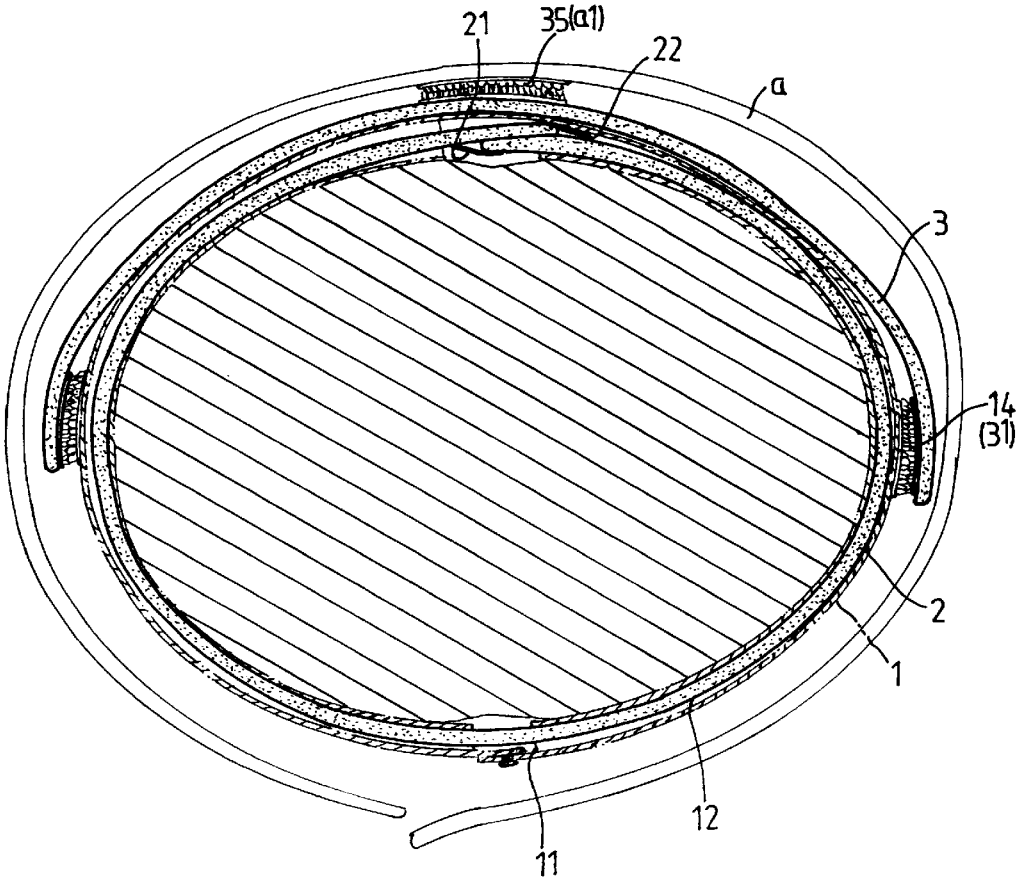
FIG. 4 is a top view in section of FIG. 2.

Referring to Figures from 1 through 4, a bulletproof vest in accordance with the present invention is generally comprised of a vest body 1, a front bulletproof shield 2, and a rear bulletproof shield 3.

The vest body 1 is a front-open design, comprising two receiving spaces 12 respectively defined in the two front panels thereof, each receiving space 12 having a front opening 11 disposed at the front placket and a rear opening 13 disposed at the back panel thereof at an inner side, and two pads of loop material (or hook material) 14 bilaterally fixedly provided two opposite lateral sides of the back panel near the two front panels on the outside. The receiving spaces 12 in the two front panels of the vest body 1 can have a common rear opening 13.

The front bulletproof shield 2 fits the front side (front panels) of the vest body 1, comprising at least one, for example, two hooks 21 provided at one extended lateral side portion thereof and inserted through the front opening 11 at one receiving space 12 out of the corresponding rear opening 13, and at least one, for example, two hook holes 22 provided at an opposite extended lateral side portion thereof and inserted through the front opening 11 at the other receiving space 12 out of the corresponding rear opening 13 and then respectively fastened up with the hooks 21.

The rear bulletproof shield 3 fits over the back panel of the vest body 1, comprising two pads of hook material (or loop material) 31 bilaterally fixedly provided at the front side wall thereof and respectively fastened to the pads of loop material (or hook material) 14 at the vest body 1, two suspenders 32 respectively provided at two opposite lateral sides for fastening to the user's pants, two shoulder straps 33 bilaterally provided at the top side thereof for fastening to the user's shoulders, two loops 34 bilaterally provided between the suspenders 32 and the straps 33 for fastening with the shoulder straps 33, and a pad of loop material (or hook material) 35 at the back side wall thereof at the top for fastening to a pad of hook material (or loop material) a1 at a jacket a for enabling the bulletproof vest to be used with the jacket a.

Figure 5:
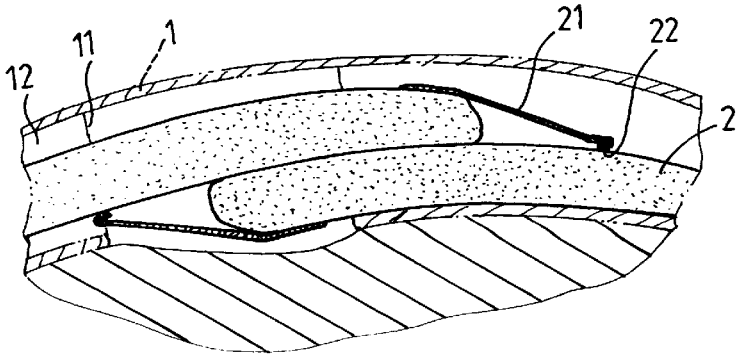
FIG. 5 is an enlarged view of a part of FIG. 4 showing the hooks at the front bulletproof shield fastened to the respective hook holes.

After the vest body 1 has been put on the user's body, the front bulletproof shield 2 is mounted in the receiving spaces 12, and then the hooks 21 at one extended lateral side portion of the vest body 1 are respectively fastened to the hook holes 22 at the other extended lateral side portion of the vest body 1 (see FIG. 5), and then the pads of hook material (or loop material) 31 of the rear bulletproof shield 3 are respectively fastened to the pads of loop material (or hook material) 14 at the vest body 1 to secure the rear bulletproof shield 3 to the back panel of the vest body 1, and then the shoulder straps 33 are wound around the user's shoulders and respectively fastened to the loops 34, and then the suspenders 32 are respectively fastened to the user's pants, and then the jacket a is put on the user's body, enabling the pad of a pad of hook material (or loop material) a1 at a jacket a to be fastened to the pad of loop material (or hook material) 35 at the rear bulletproof shield 3. After wearing of the jacket a, the bulletproof vest is concealed from sight.

Figure 6:
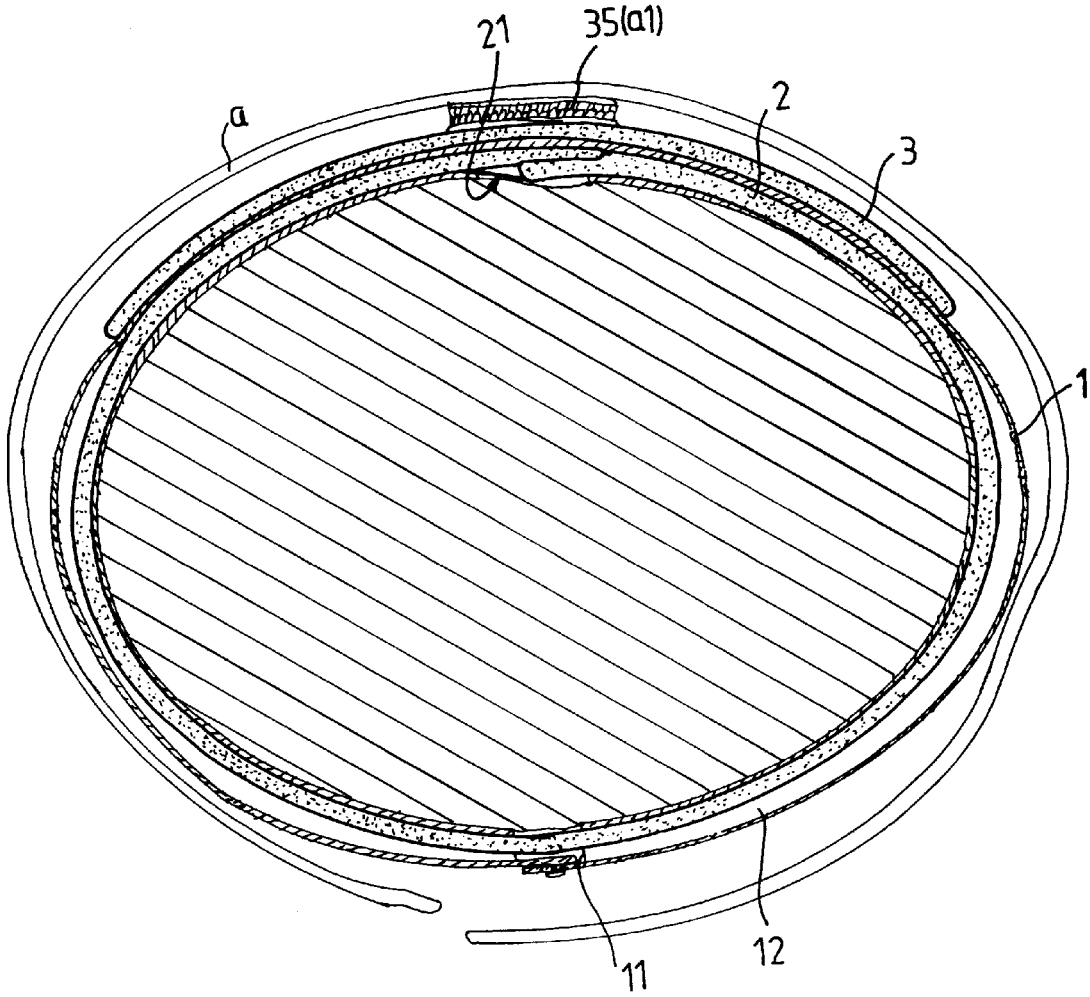
FIG. 6 is top view in section of an alternate form of the present invention, showing the pads of loop material (or hook material) eliminated from the vest body, the pads of hook material (or loop material) eliminated from the rear bulletproof shield.
Figure 7:
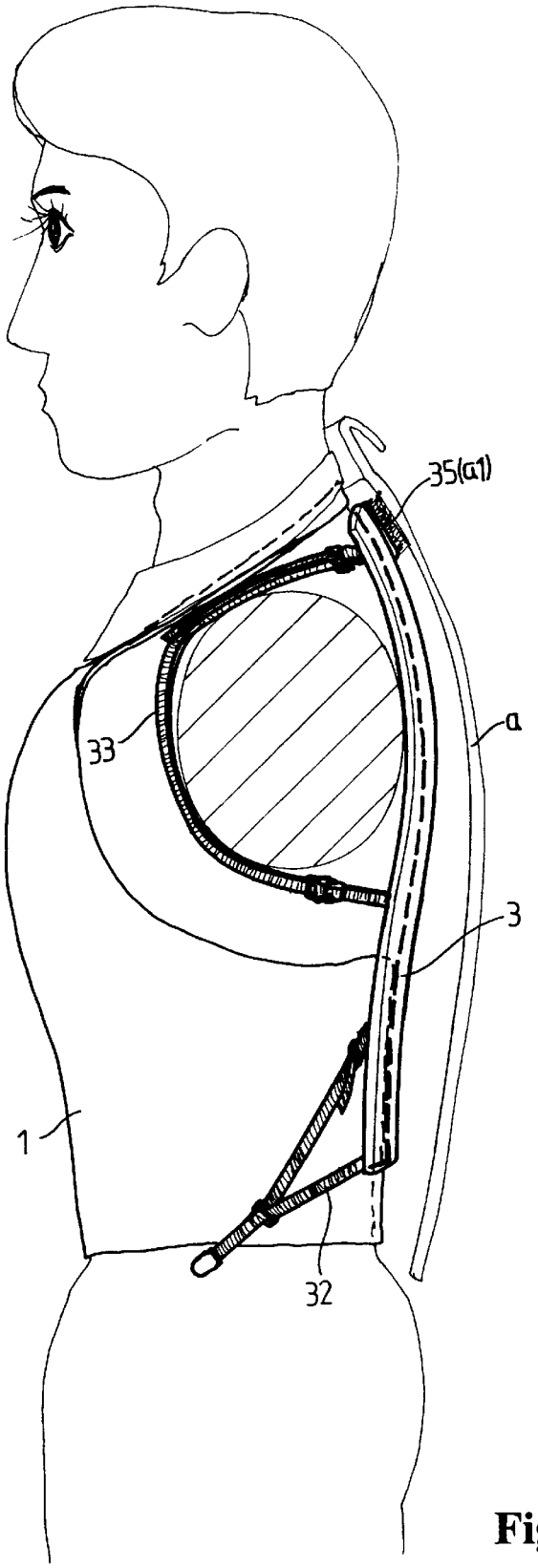
FIG. 7 is a side view in section of FIG. 6.

FIGS. 6 and 7 show an alternate form of the present invention. According to this embodiment, the aforesaid pads of loop material (or hook material) 14 are eliminated from the vest body 1, and the aforesaid pads of hook material (or loop material) 31 are eliminated from the rear bulletproof shield 3.

Figure 8:
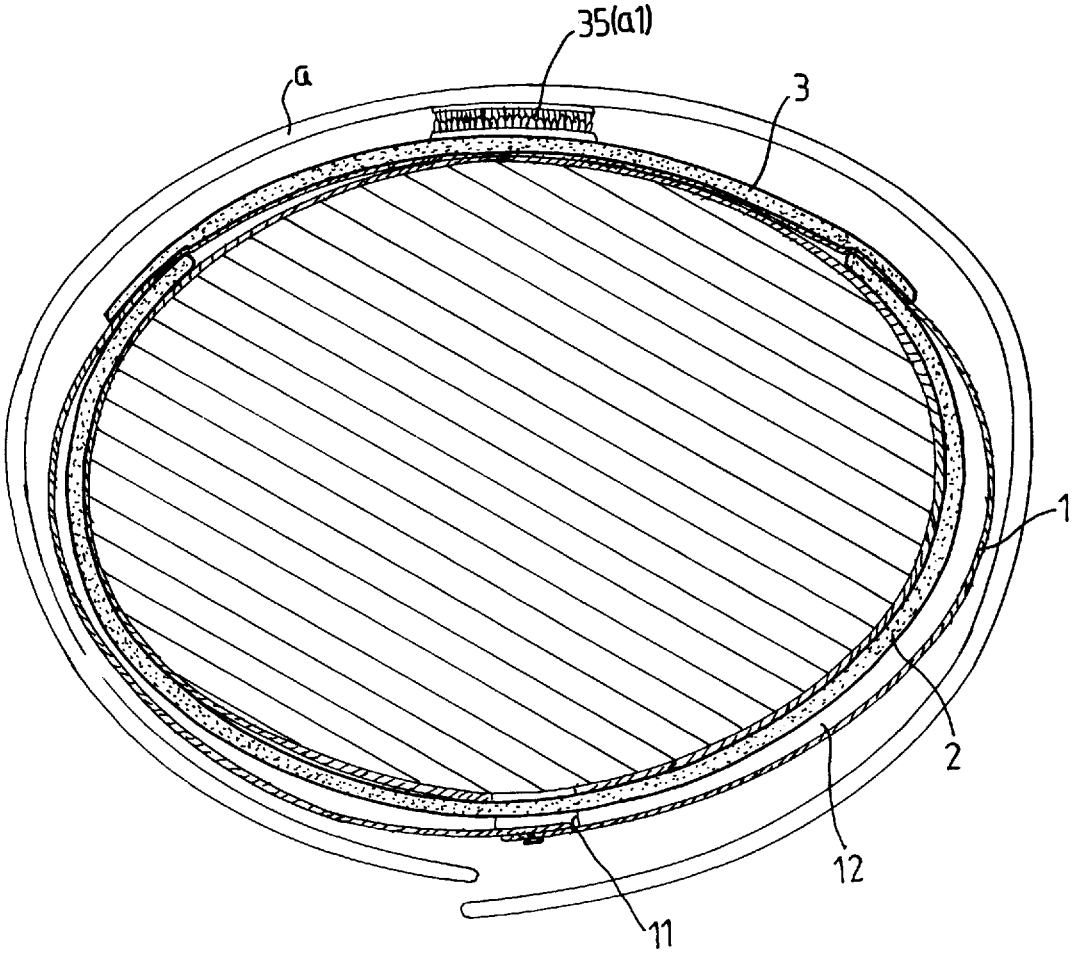
FIG. 8 is a top view in section of another alternate form of the present invention, showing the common rear opening pads of loop material (or hook material) eliminated from the vest body, the aforesaid hooks and hook holes eliminated from the front bulletproof shield, the pads of hook material (or loop material) eliminated from the rear bulletproof shield.

FIG. 8 shows another alternate form of the present invention. According to this alternate form, the aforesaid common rear opening 13 and pads of loop material (or hook material) 14 are eliminated from the vest body 1, the aforesaid hooks 21 and hook holes 22 are eliminated from the front bulletproof shield 2, the aforesaid pads of hook material (or loop material) 31 are eliminated from the rear bulletproof shield 3.

Figure 9:
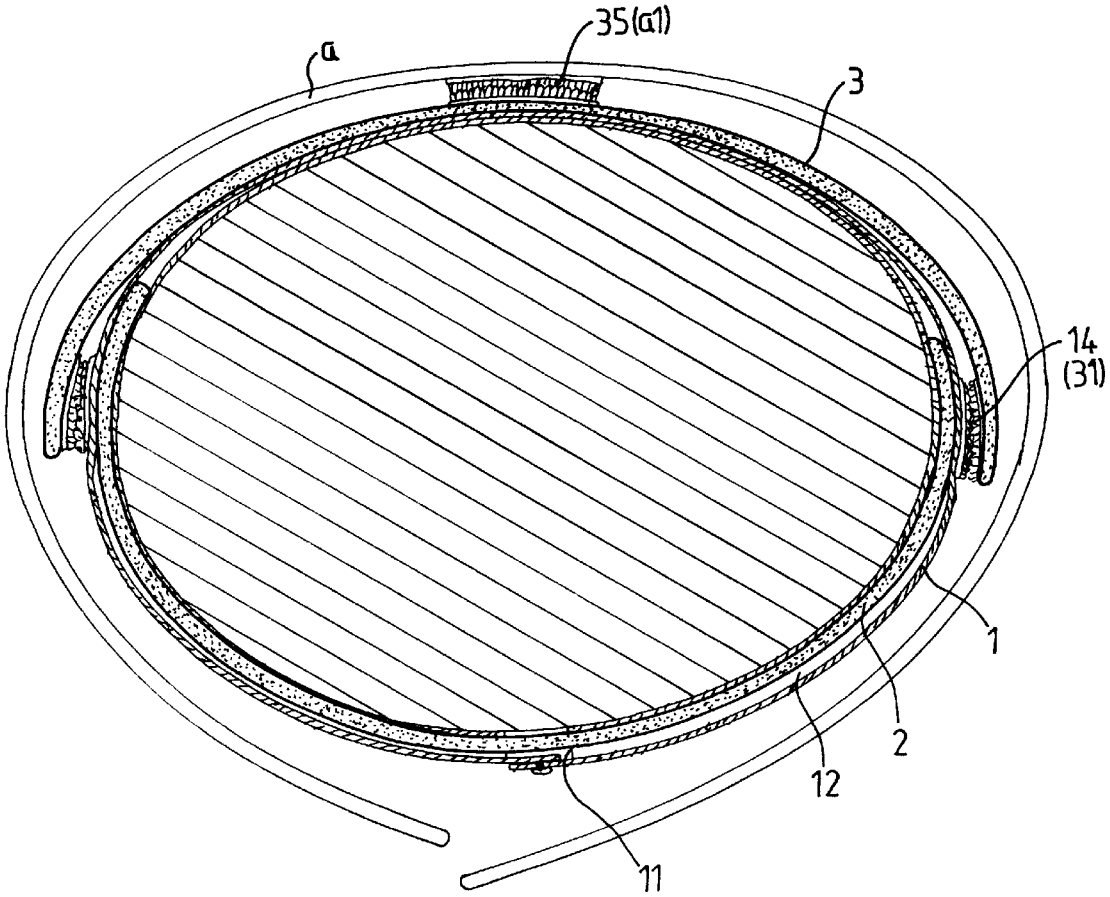
FIG. 9 is a top view in section of still another alternate form of the present invention, showing the common rear opening eliminated from the vest body, and the hooks and hook holes eliminated from the front bulletproof shield.

FIG. 9 shows another alternate form of the present invention. According to this alternate form, the aforesaid common rear opening 13 are eliminated from the vest body 1, and the aforesaid hooks 21 and hook holes 22 are eliminated from the front bulletproof shield 2. This embodiment keeps and the pads of loop material (or hook material) 14 at the vest body 1 and the pads of hook material (or loop material) 31 at the rear bulletproof shield 3.

Figure 10:
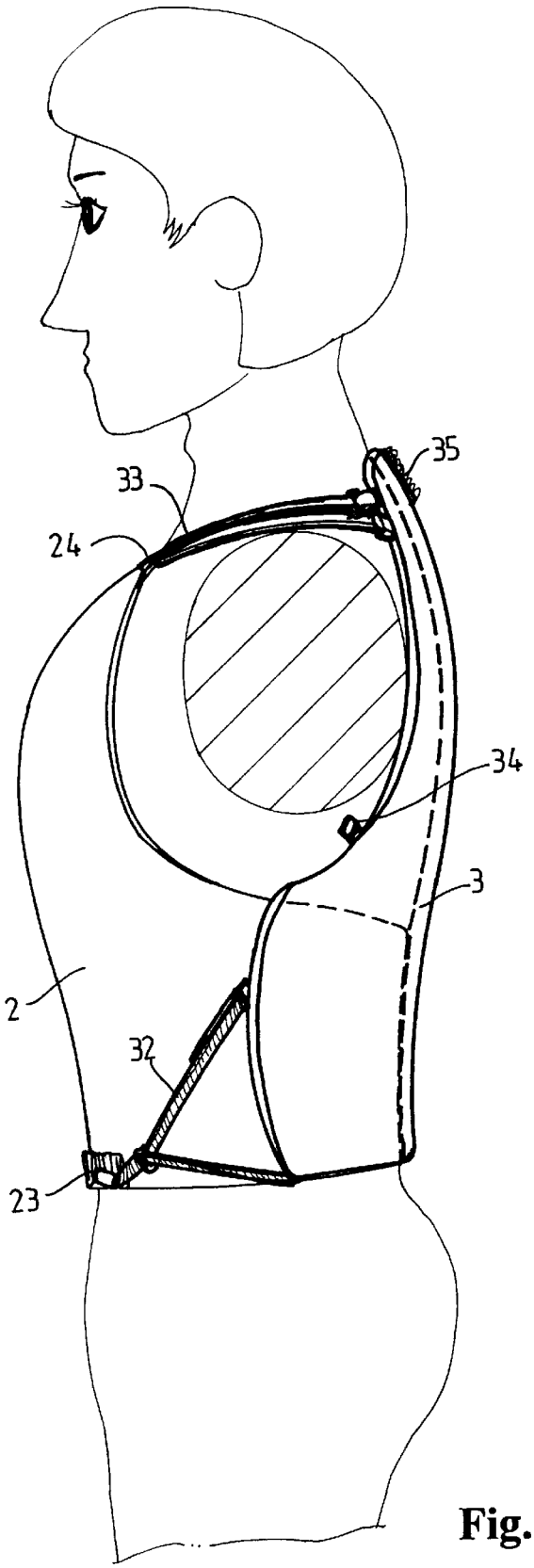
FIG. 10 is a side view in section of still another alternate form of the present invention without the vest body.

Referring to FIG. 10 and FIG. 1 again, two retaining elements 23 are provided at the front side of the front bulletproof shield 2 on the middle near the bottom side for receiving the suspenders 32 at the rear bulletproof shield 3, and two loops 24 are provided at the front bulletproof shield 2 at the top side corresponding to the shoulders for receiving the shoulder straps 33 at the rear bulletproof shield 3. This arrangement enables the front bulletproof shield 2 and the rear bulletproof shield 3 to be directly fastened together to protect the user's body without the vest body 1.

Figure 11:
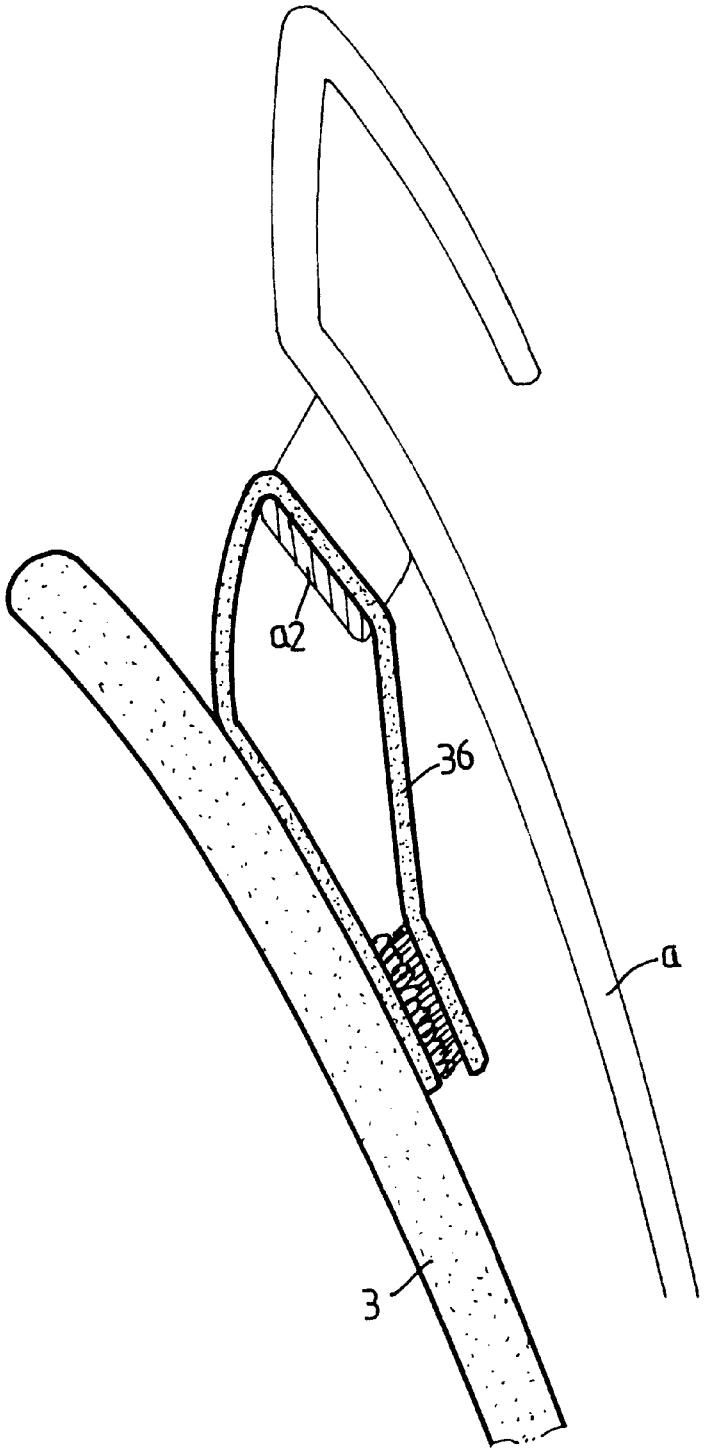
FIG. 11 is a sectional view in an enlarged scale of a part of still another alternate form of the present invention, showing a flexible fastening member fixedly provided at the back side wall of the rear bulletproof shield and fastened to a loop at the jacket.

Referring to FIG. 11, a flexible fastening member 36 is fixedly provided at the back side wall of the rear bulletproof shield 3 for securing the rear bulletproof shield 3 to a loop a2 inside a jacket a. The flexible fastening member 36 is a strip of fabric having a fixed end fixedly fastened to the rear bulletproof shield 3 and provided with a tape of loop material (or hook material), and a free end provided with a tape of hook material, which is inserted through the loop a2 at the jacket a and then fastened to the tape of loop material (or hook material) at the fixed end of the flexible fastening member 36 to secure the rear bulletproof shield 3 to the jacket a.

Figure 12:
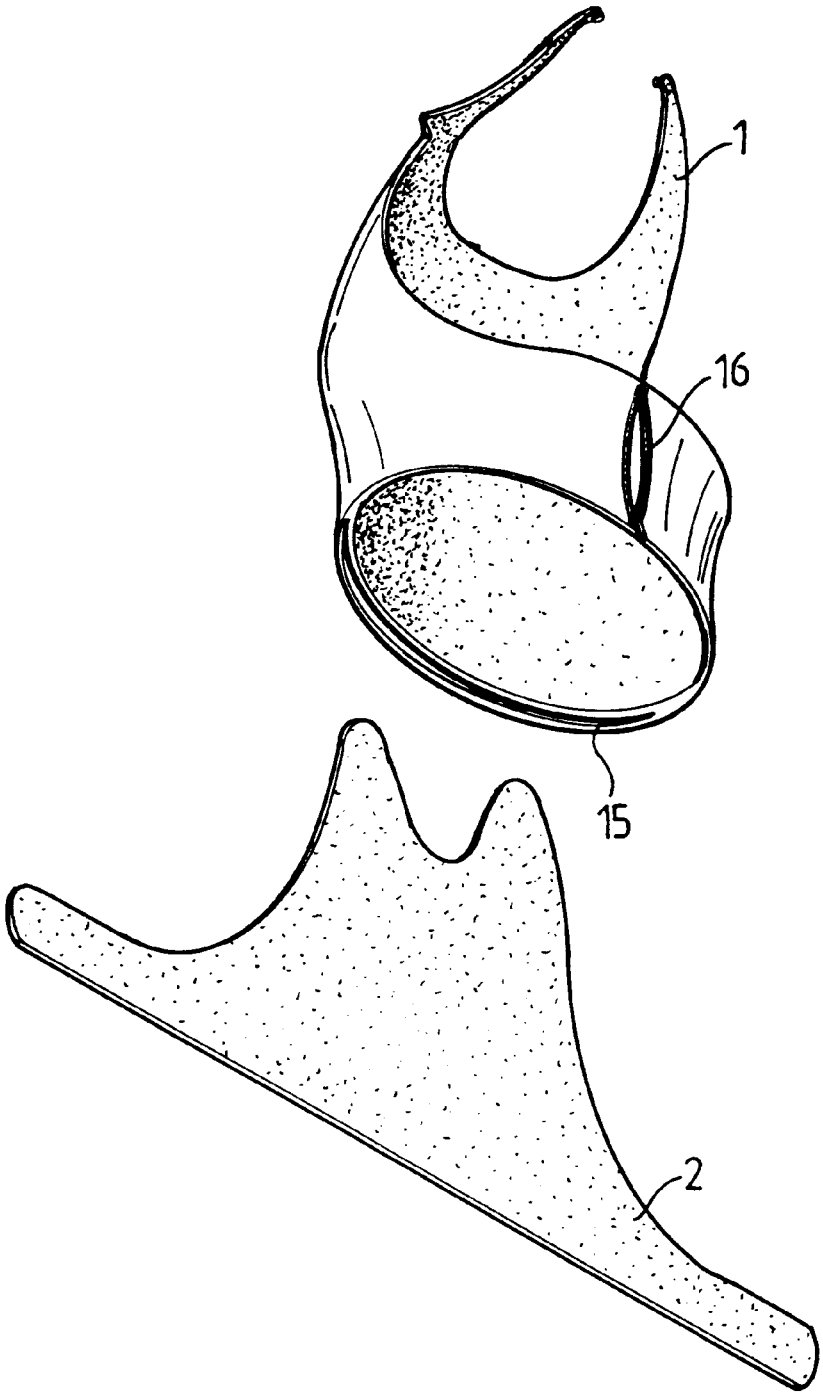
FIG. 12 is an exploded view of still another alternate form of the according to the present invention.
Figure 13:
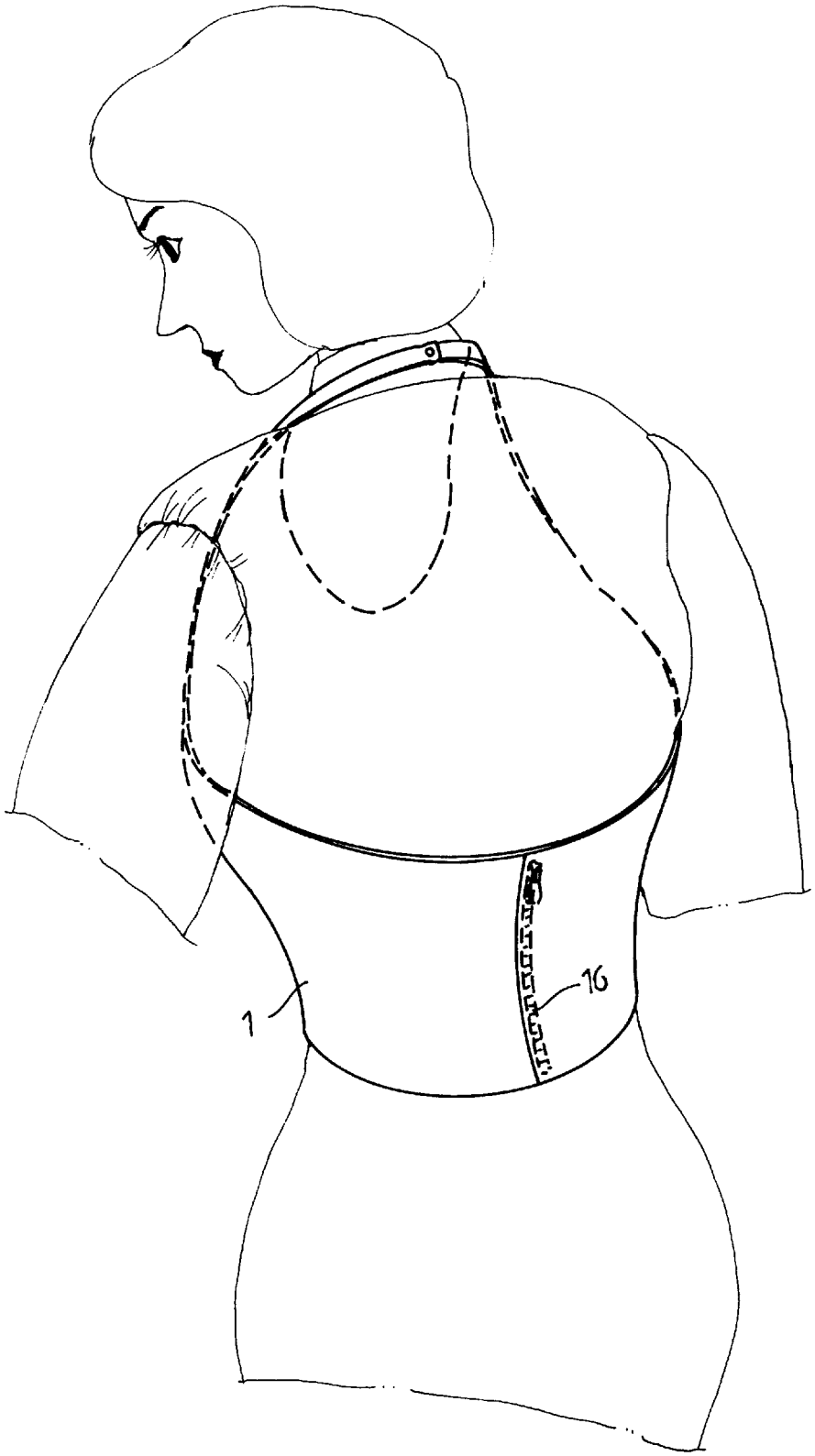
FIG. 13 is a schematic drawing showing the bulletproof vest fastened to the user's body.
Figure 14:
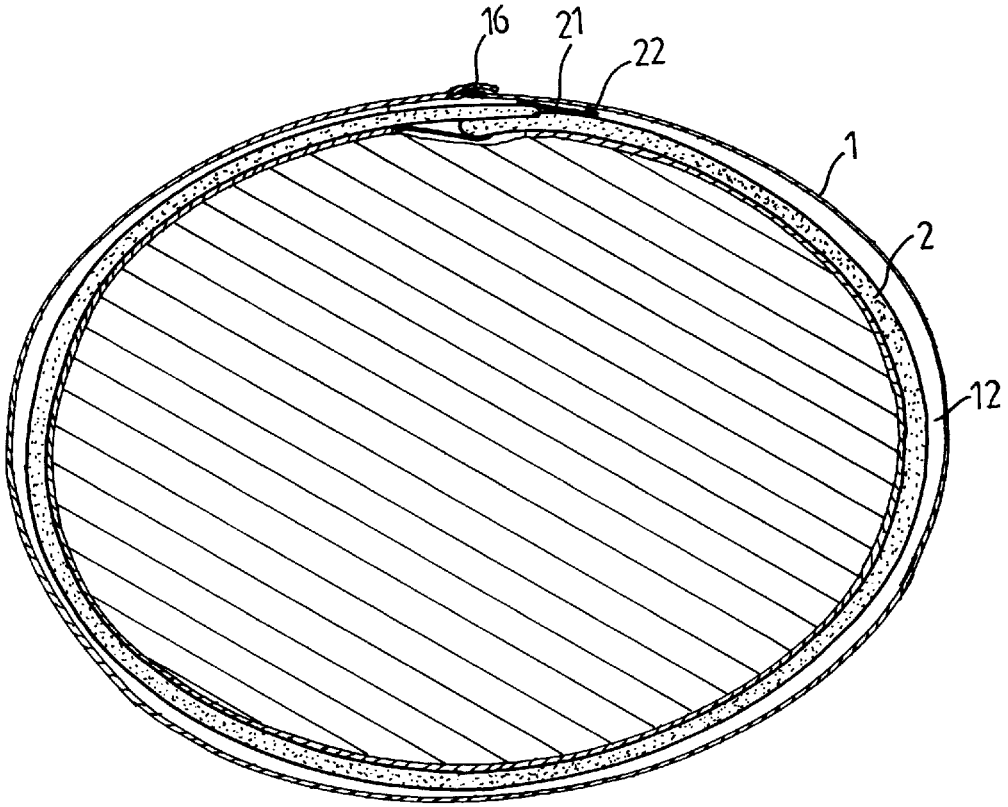
FIG. 14 is a top view in section of FIG. 13.

FIGS. 12 through 14 show still another alternate form of the present invention. According to this embodiment, the vest body 1 is a back-open design, having a zip fastener 16 at the backside thereof, and a bottom opening 15 at the vest bottom thereof. The front bulletproof shield 2 is inserted through the bottom opening 15 into the inside of the vest body 1, and then the hooks 21 are respectively hooked in the hook holes 22 to secure the vest body 1 and the front bulletproof shield 2 to the user's body. The embodiment eliminates the use of the aforesaid rear bulletproof shield 3.

It is to be understood that the drawings are designed for purposes of illustration only and are not intended as a definition of the limits and scope of the invention disclosed.

What the invention claimed is:

1. A bulletproof vest comprising:

a vest body, said vest body comprising two receiving spaces respectively defined in two front panels thereof, two front openings respectively disposed at a front placket thereof in communication with said receiving spaces, and a rear opening disposed at a back panel thereof at an inner side between said receiving spaces;

a front bulletproof shield mounted in the receiving spaces inside said vest body to protect the user's front side against bullet, said front bulletproof shield having two opposite extended lateral side portions respectively extended out of the rear opening at said vest body and fastened together; and a rear bulletproof shield fastened to said vest body at a backside to protect the user's backside against bullet.

2. The bulletproof vest of claim 1 wherein said front bulletproof shield comprises at least one hook respectively provided at one of said opposite extended lateral side portions, and at least one hook hole respectively provided at the other of said two extended lateral side portions for receiving said at least one hook.

3. The bulletproof vest of claim 1 wherein said rear bulletproof shield comprises two suspenders respectively provided at two opposite lateral sides thereof for fastening to the user's pants.

4. The bulletproof vest of claim 3 wherein said rear bulletproof shield further comprises two loops bilaterally provided on the middle, and two shoulder straps bilaterally provided near a top side thereof and respectively fastened to said loops to secure said rear bulletproof shield to the user's shoulders.

5. The bulletproof vest of claim 4 wherein hook and loop materials are respectively provided at said vest body and said rear bulletproof shield for enabling said rear bulletproof shield to be detachably fastened to said vest body.

6. The bulletproof vest of claim 1 wherein said front bulletproof shield comprises two retaining elements respectively provided at a front side thereof, and said rear bulletproof shield comprises two suspenders respectively provided at two opposite lateral sides thereof for fastening to the retaining elements at said front bulletproof shield.

7. The bulletproof vest of claim 1 wherein said rear bulletproof shield comprises a fastening device at a back side wall thereof for fastening to a matching fastening device at the inside of a short coat.

8. The bulletproof vest of claim 7 wherein the fastening device at the back side wall of said rear bulletproof shield is a pad of loop material for fastening to a pad of hook material at the inside of a short coat.

9. The bulletproof vest of claim 7 wherein the fastening device at the back side wall of said rear bulletproof shield is a pad of hook material for fastening to a pad of loop material at the inside of a short coat.

10. The bulletproof vest of claim 7 wherein the fastening device at the back side wall of said rear bulletproof shield is a suspended strip of hook and loop materials for fastening to a loop at the inside of a short coat.

* * * * *